US007326125B2

(12) United States Patent
Moriyama

(10) Patent No.: US 7,326,125 B2
(45) Date of Patent: Feb. 5, 2008

(54) GOLF CLUB

(75) Inventor: Keiji Moriyama, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 239 days.

(21) Appl. No.: 11/287,395

(22) Filed: Nov. 28, 2005

(65) Prior Publication Data

US 2006/0142093 A1 Jun. 29, 2006

(30) Foreign Application Priority Data

Dec. 28, 2004 (JP) ..... 2004-380248
Oct. 7, 2005 (JP) ..... 2005-295311

(51) Int. Cl.
*A63B 53/00* (2006.01)
*A63B 53/04* (2006.01)

(52) U.S. Cl. ..... 473/292; 473/324

(58) Field of Classification Search ..... None
See application file for complete search history.

(56) References Cited

U.S. PATENT DOCUMENTS 6,835,143 B2 * 12/2004 Shiraishi ..... 473/291
2002/0142855 A1 * 10/2002 Cook et al. ..... 473/282
2004/0248667 A1 * 12/2004 Cackett et al. ..... 473/349

FOREIGN PATENT DOCUMENTS

JP 11-099231 A 4/1997
JP 2000202070 A * 7/2000
JP 2004-201911 A 7/2002

* cited by examiner

*Primary Examiner*—Eugene Kim
*Assistant Examiner*—Alvin A Hunter
(74) *Attorney, Agent, or Firm*—Birch, Stewart, Kolasch & Birch, LLP

(57) ABSTRACT

A golf club comprises a club shaft having a tip end and a butt end, a golf club head being attached to the tip end of the club shaft, and a golf grip being attached to a region of the club shaft extending from the butt end toward the tip end of the club shaft, the golf grip having an upper end by the side of the butt end of said club shaft, wherein the golf club has a club entire length in the range of from 46 to 48 inch, the golf club has a swing weight of from C5 to D0 based on 14-inch balance method, and the golf club has a moment of inertia in the range of from 2850 to 3000 kg·cm$^2$ at the position of the upper end of the golf grip.

9 Claims, 10 Drawing Sheets

GOLF CLUB

BACKGROUND OF THE INVENTION

1. Field of the Invention

The present invention relates to a golf club which can be easily swung and can obtain a long carry.

2. Description of the Related Art

Wood type golf clubs such as a driver, a fairway wood or the like, are required a carry performance which can hit a ball farther. In general, the carry can be effectively improved by increasing an initial velocity of a hit ball. In order to increase the initial velocity of the hit ball, an improvement of a repulsion performance of a club head, an increase of a kinetic energy of the head obtained by increasing a weight of the club head and an improvement of a head speed obtained by elongating a club are proposed.

However, the repulsion performance of the club head tends to be regulated by USGA and R&A. Accordingly, the club head in which the repulsion performance is largely improved can not be used in an official competition in the future.

Further, the other two methods tend to make it hard to swing the club. For example, the club having a long entire length is hard to be swung, and makes it hard to control a face of the club head. In particular, a lot of golfers tend to hit the ball in a state in which the face is opened, and there tends to be generated a slice ball in which the hit ball flies in a rightward direction (hereinafter in the present specification, the descriptions are given on the basis of a right-handed golfer unless otherwise noted).

Thus, the inventors have tried to achieve both an improvement of a head speed and an easiness of a swing on the basis of an elongation of the club.

The inventors have found that there are two moments which particularly affect the easiness of the swing during a series of swing motions from a backswing (a take back) to a ball impact. One is a moment corresponding to a start of the backswing at which the stationary golf club is moved, and the other is a moment just before the ball is impacted. In both of the moments, a position near a right hand end of the golfer holding a grip forms a supporting point (in other words, a center of a rotational motion of the club). Accordingly, the inventors have found that the swing easiness of the club can be improved by improving an operability of the club at these two moments.

SUMMARY OF THE INVENTION

A main object of the present invention is to provide a golf club which can be easily swung and can carry a ball farther by extension.

In accordance with the present invention, the golf club comprises a club shaft having a tip end and a butt end, a golf club head being attached to the tip end of the club shaft, and a golf grip being attached to a region of the club shaft extending from the butt end toward the tip end of the club shaft, the golf grip having an upper end by the side of the butt end of the club shaft, wherein the golf club has a club entire length in the range of from 46 to 48 inch, the golf club has a swing weight of from C5 to D0 based on 14-inch balance method, and the golf club has a moment of inertia in the range of from 2850 to 3000 kg·cm$^2$ at the position of the upper end of said golf grip.

The golf club in accordance with the present invention is easily swung in spite of being long such as 46 to 48 inch. Accordingly, it is possible to achieve both of an improvement of a head speed and an excellent head control. Therefore, it is possible to carry a ball farther in an intended direction.

DESCRIPTION OF THE PREFERRED EMBODIMENT

Embodiment of the present invention will now be described in detail in conjunction with the accompanying drawings.

Figure 1:
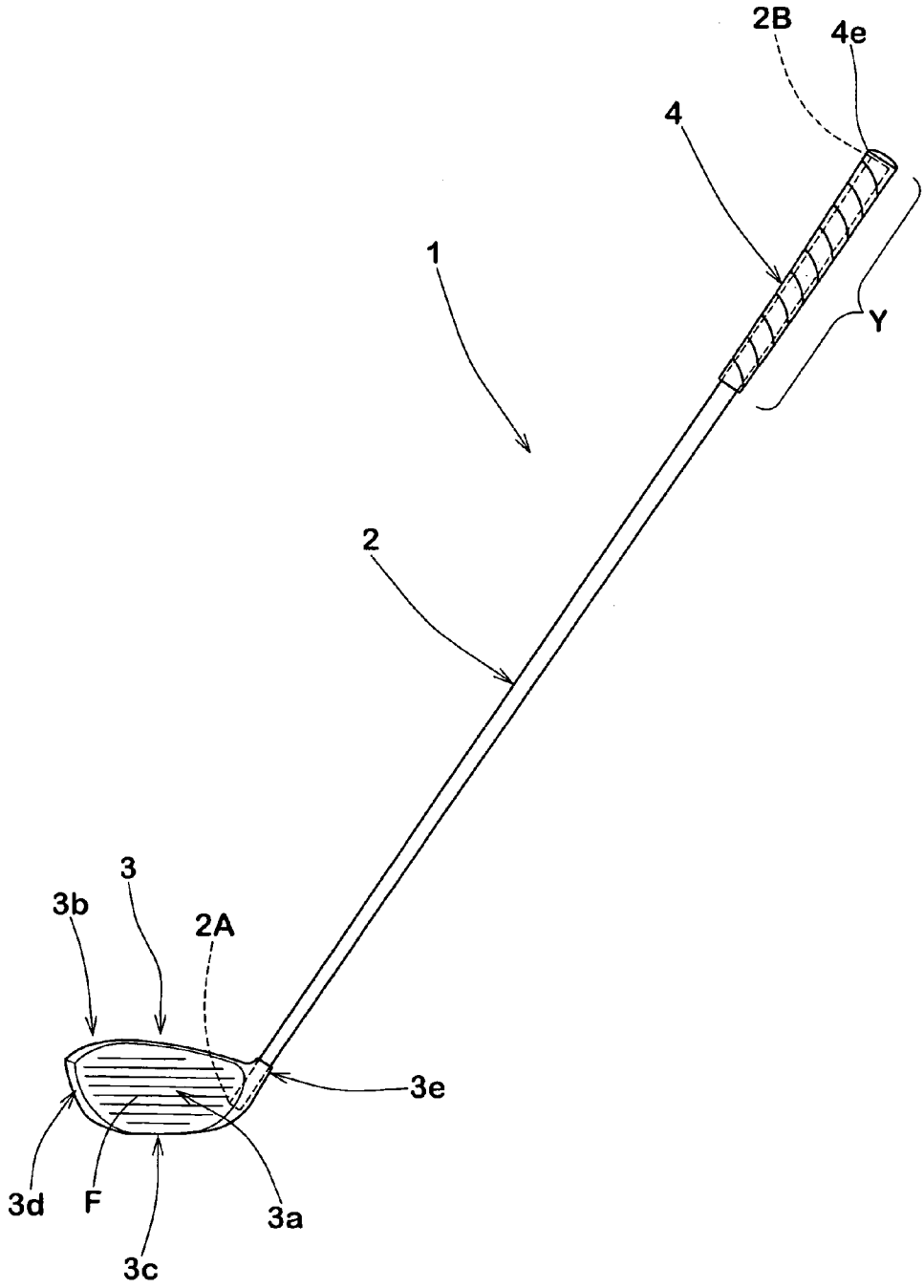
FIG. 1 is a front elevational view of a golf club showing an embodiment in accordance with the present invention.

FIG. 1 shows an entire front elevational view of a golf club in accordance with the present embodiment.

The golf club 1 in accordance with the present embodiment is shown as a wood-type golf club at least including such as a brassy (#2), a spoon (#3), and a baffy (#4) or a cleek (#5), in addition to a driver (#1).

The golf club 1 comprises: a club shaft 2 with a tip end 2A and a butt end 2B; a golf club head 3 being attached to the tip end 2A of the club shaft 2; and a golf grip 4 being attached to a region Y of the club shaft 2 extending from the butt end 2B toward the tip end 2A of the club shaft 2.

The golf club 1 in accordance with the present invention is characterized in that a club entire length L is in the range of from 46 to 48 inch, a swing weight in accordance with the 14-inch balance measuring method is from C5 to D0, and a moment of inertia of the club 1 at an upper end 4*e* of the grip 4 is in the range of from 2850 and 3000 kg·cm$^2$.

The inventors first employ the swing weight based on a 14-inch balance method as a parameter for quantifying the operability at two moments mentioned above, and try to optimize the swing weight.

Next, in a turning action from the backswing to the downswing in the swing motion, the golf club 1 turns around a left hand of the golfer as a fulcrum. Accordingly, in order to improve the easiness of swinging the club 1, it is further necessary to improve the operability of the club 1 around the left hand position of the golfer holding the grip 4. So, the present invention employs a moment of inertia of the club 1 at the upper end 4*e* of the golf grip which is comparatively near the left hand, as a parameter for quantifying the operability, and tries to define the moment of inertia.

Figure 2:
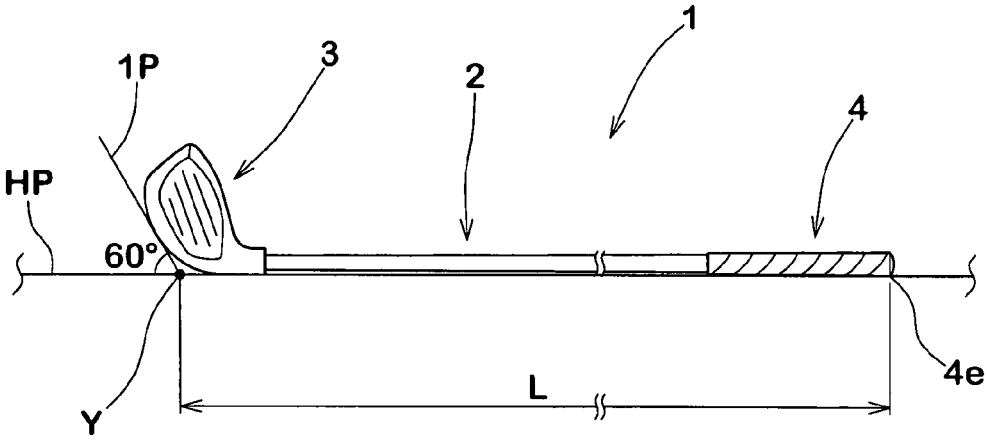
FIG. 2 is a graph explaining an entire length of a club.

The club 1 has a club entire length L in the range of from 46 to 48 inch. Here, the "club entire length" mentioned above is measured on the basis of "c. Length" in an item of an auxiliary rule. II, "1. Club" in JGA (Japan Golf Association) golf rule. In particular, the lengths of wood type and iron type clubs are measured by placing a golf club 1 on a horizontal plane HP as shown in FIG. 2, and applying an inclined plane IP which is inclined at 60 degree with respect to the horizontal plane HP to a sole portion of a club head 3. The club entire length L is measured as a distance from an intersection Y between two planes HP and IP to the upper end 4*e* of the golf grip 4.

A head speed at a time of hitting the ball is increased approximately in proportion to the club entire length L. Accordingly, in the case that the club entire length L is less than 46 inch, an improvement of the head speed for achieving a significant increase of a carry can not be sufficiently expected. On the contrary, if the length L is more than 48 inch, an operability of the club 1 is deteriorated, and the club entire length L commits an offence against the golf rule.

Although the club entire length L is not particularly limited, it is desirable that the length L is preferably not less than 46.5 inch, and more preferably not less than 47 inch.

Figure 3:
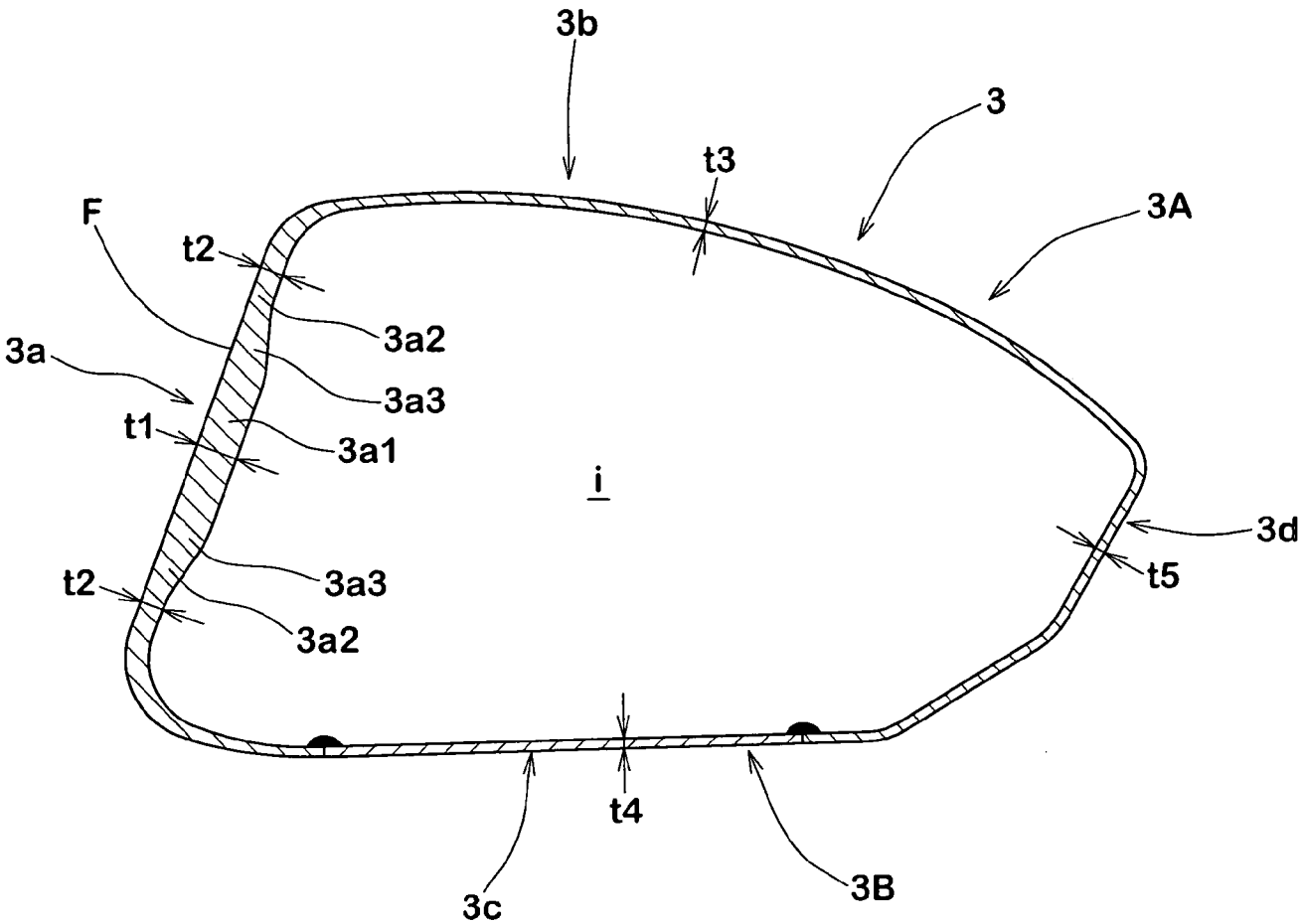
FIG. 3 is an enlarged cross sectional view of a golf club head.

As shown in FIG. 3, the club head 3 in accordance with the present embodiment preferably comprises a hollow wood-type structure with a hollow i and is made of a metal material. Although the metal material is not particularly limited, one or two or more of an aluminum alloy, a titanium, a titanium alloy, a stainless or a magnesium alloy, and the like are used, for example. Further, the club head 3 can include a non-metal material such as a fiber reinforcing resin (FRR) or the like at least in a part thereof in order to reduce a weight thereof.

The club head 3 comprises: a face portion 3*a* whose front face defines the club face F for hitting a ball; a crown portion 3*b* intersecting the club face F at the upper edge thereof; a sole portion 3*c* intersecting the club face F at the lower edge thereof; a side portion 3*d* between the crown portion 3*b* and the sole portion 3*c* which extends from a toe-side edge to a heel-side edge of the club face F through the back face of the club head 3; and a hosel 3*e* to be attached to the tip end 2A of the club shaft 2.

The face portion 3*a* includes, for example, a center portion 3*a*1 with a large thickness t1, and a peripheral portion 3*a*2 extending annularly so as to surround the center portion 3*a*1 and having a thickness t2 smaller than the thickness t1. since the peripheral portion 3*a*2 is largely bent at a time of hitting the ball, the face portion 3*a* can increase a restitution coefficient of the club head to the maximum, for example, within the range of the golf rule, and serves for reducing the weight of the face portion 3*a* and lightening the club head 3. Further, the center portion 3*a*1 serves for improving a durability of the face portion 3*a*.

From the point of view mentioned above, it is desirable that the thickness t1 of the center portion 3*a*1 is preferably not less than 2.7 mm, and more preferably not less than 2.8 mm, and it is desirable that an upper limit thereof is preferably not more than 3.1 mm, and more preferably not more than 3.0 mm. In the same manner, it is desirable that the thickness t2 of the peripheral portion 3*a*2 is, for example, not less than 1.9 mm, and more preferably not less than 2.0 mm, and it is desirable that an upper limit thereof is preferably not more than 2.5 mm, and more preferably not more than 2.4 mm.

Further, it is desirable that the face portion 3*a* is provided with a transition portion 3*a*3 with a smoothly changing thickness and coupling between the center portion 3*a*1 and the peripheral portion 3*a*2. Accordingly, the transition portion 3*a*3 serves for preventing a stress concentration in a boundary portion between the center portion 3*a*1 and the peripheral portion 3*a*2 of the face portion 3*a* or the like, and improving durability.

Further, although respective thicknesses t3 and t5 of the crown portion 3*b* and the side portion 3*d* are not particularly limited, too large thickness tends to increase the head weight and make it hard to regulate the swing weight, and too small thickness tends to lower a durability of the club head 3. From this point of view, it is desirable that each of the thicknesses t3 and t5 is preferably not less than 0.7 mm, and more preferably not less than 0.8 mm and it is desirable that an upper limit thereof is preferably not more than 1.1 mm, and more preferably not more than 1.0 mm.

Further, the sole portion 3*c* has many chances to be in contact with the ground at a time of swinging. Accordingly, in order to secure the durability, it is desirable that the sole portion 3*c* is preferably formed at a larger thickness t4 than that of the crown portion 3*b*. On the other hand, too large thickness t4 is not preferable because the weight of club head tends to be increased. From this point of view, it is desirable that the thickness t4 of the sole portion 3*c* is preferably not less than 0.9 mm, and more preferably not less than 1.1 mm and it is desirable that an upper limit thereof is preferably not more than 1.5 mm, and more preferably not more than 1.3 mm.

If the weight of the club head 3 is too small, the kinetic energy of the club head 3 at a time of swinging is relatively lowered, and there is a tendency that the carry increasing effect on the basis of the elongation of the club can not be sufficiently achieved. On the contrary, if the weight of the club head 3 is too large, there is a tendency that it is hard to provide a golf club with a suitable swing weight. In this point of view, the weight of the club head 3 is not particularly limited, but it is desirable that the weight is preferably not less than 180 g, and further preferably not less than 185 g. Further, it is desirable that an upper limit thereof is not more than 195 g, more preferably not more than 193 g, and further preferably not more than 191 g.

The volume of the club head 3 is not particularly limited, but it is desirable that the volume is preferably not less than 350 cc, more preferably not less than 380 cc, and further preferably not less than 400 cc. Further, it is desirable that an upper limit thereof is preferably not more than 500 cc, and more preferably not more than 470 cc. If the volume of the club head 3 is too small, there is a tendency that it is hard to enlarge the moment of inertia of the club head. On the contrary, if the volume becomes too large, there is a tendency that the weight of the club head 3 is increased and the club head 3 is hard to be swung.

Further, the club head 3 can be manufactured, for example, by preparing a plurality of (for example, two to four) parts for the club head, and approximately attaching each other. These parts can be formed, for example, by casting, forging, press forming, or a combination thereof. Further, as an attaching method of these parts, for example, it is possible to employ welding, adhesive bonding, brazing, diffusion bonding, caulking, or the like.

The club head 3 in accordance with the present embodiment is formed by a main body portion 3A constituted by an integrally cast product with an opening on the sole portion 3*c*, and a sole plate 3B being attached to the opening so as to be welded.

The club shaft 2 mentioned above is, for example, made of a fiber reinforcing resin comprising a plurality of prepreg plies. Such a club shaft 2 is easily swung through due to its light weight, and has a high freedom of design. Accordingly, the swing weight of the golf club 1 can be easily adjusted.

The prepreg ply is a sheet-like compound material of a reinforcing fiber dipped into a resin before the molding operation.

As a manufacturing method of the shaft 2, an internal pressure molding method is preferable. The method includes a step of winding a plurality of prepreg plies around a mandrel so as to form a tubular laminated material, a step of decentering the laminated material from the mandrel, a step of inserting an expandable bladder or the like into an inner portion of the laminated material, and a step of molding the laminated material in a casting mold by applying a heat with a pressure to the bladder. Accordingly, the club shaft 2 is structured as a taper-shaped tubular body in which an outer diameter is smoothly reduced from the butt end 2B toward the tip end 2A.

Also, the club shaft 2 made of the fiber reinforcing resin can be easily formed, for example, in accordance with a sheet winding manufacturing method and a filament winding manufacturing method.

The reinforcing fiber of the prepreg ply is not particularly limited, however, can employ, for example, a metal fiber such as an amorphous, a boron, a titanium, a tungsten, a stainless or the like, and an organic fiber such as an aramid, a polyparaphenylene benzobis oxazole (PBO) or the like, in addition to a carbon fiber or a glass fiber, and preferably, the carbon fiber is desirable.

Further, in accordance with the custom, a matrix resin of the prepreg ply employs an unsaturated polyester, a phenol, a vinyl ester or the like. Above all, an epoxy resin is preferable.

Figure 4:
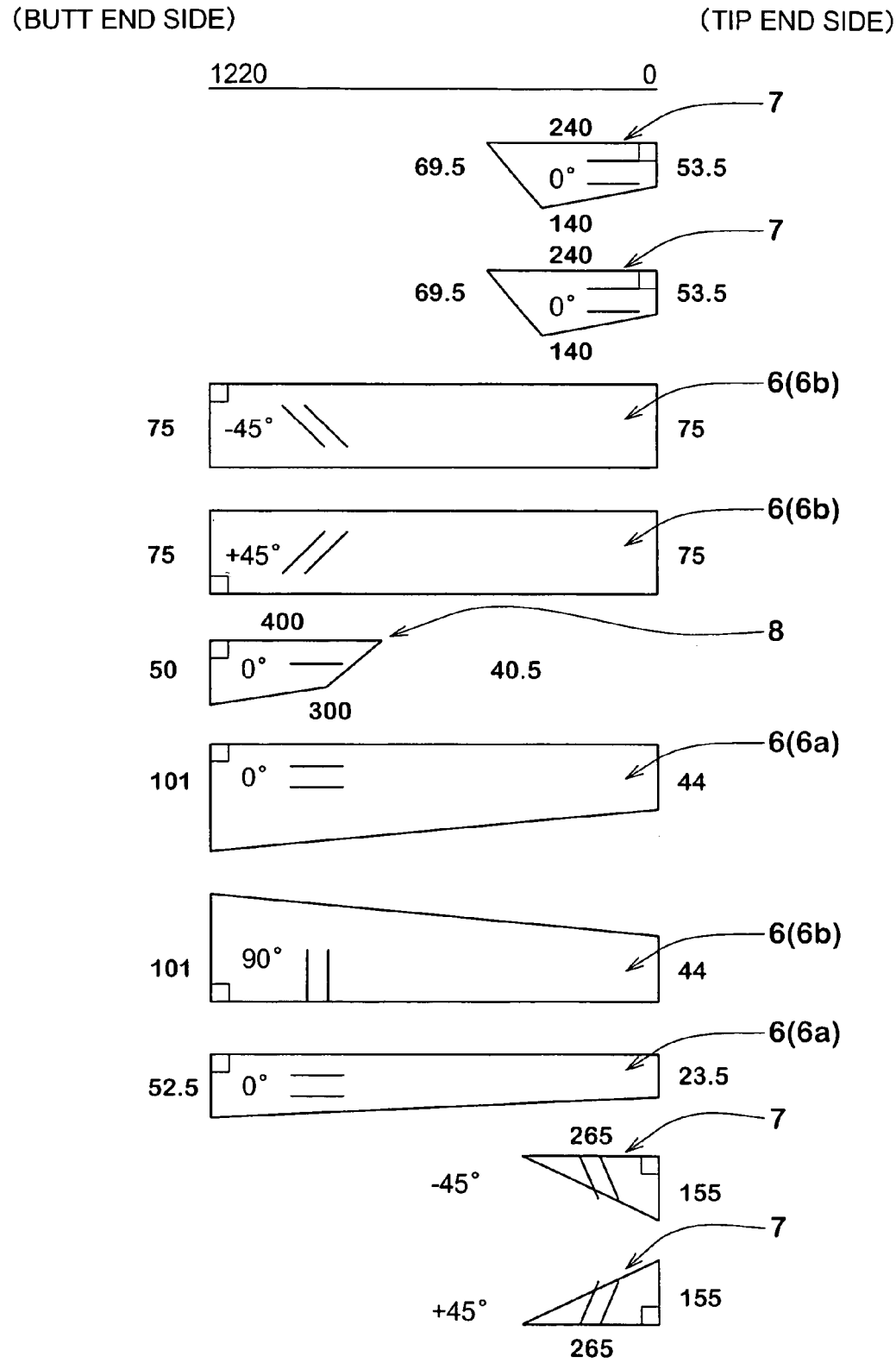
FIG. 4 is an expansion plan view of a prepreg constituting a shaft.

FIG. 4 shows an embodiment of a set of the prepreg plies constructing the club shaft 2. In FIG. 4, an expression only by a numerical value indicates a length and a width of the prepreg, and a unit thereof is millimeter. Also, a display of an angle in FIG. 4 shows an angle of the fiber f after molding the resin with respect to the axial direction of the club shaft.

The set of prepreg plies comprises at least one first prepreg ply 6 with an approximately entire length of the club shaft 2, at least one second prepreg ply 7 arranged in a small region extending from the tip end 2A toward the butt end 2B of the shaft 2, and at least one third prepreg ply 8 arranged in a small region extending from the butt end 2B toward the tip end 2A of the shaft 2. Each of the prepreg plies employs a one-way prepreg in which carbon fibers are aligned in one direction.

In the present embodiment, the first prepreg ply 6 comprises three sheets of straight plies 6*a* with the reinforcing fibers f arranged in parallel to a longitudinal direction of the club shaft 2, and three sheets of bias plies 6*b* with the fibers f arranged so as to be inclined with respect to the longitudinal direction.

The bias ply 6*b* in this embodiment includes a pry in which an angle of orientation of the fiber is ±45 degrees and 90 degree with respect to the longitudinal direction.

The straight ply 6*a* preferably comprises the reinforcing fiber f with an elastic modulus in tension in the range of from 10000 to 30000 kgf/mm$^2$. Further, each of the bias ply 6*b* preferably comprises the reinforcing fiber f with an elastic modulus in tension being larger than the straight ply 6*a*, above all equal to or more than 24000 kgf/mm$^2$, more preferably not less than 30000 kgf/mm$^2$ and not more than 80000 kgf/mm$^2$, and more preferably not more than 60000 kgf/mm$^2$.

In general, there is a tendency that a tensile strength is lowered in accordance with the fiber with the larger elastic modulus in tension. Accordingly, it is desirable to secure the strength of the club shaft 2 by using the fiber in which the elastic modulus is not more than 30000 kgf/mm$^2$ in the straight ply 6*a* greatly affecting the bending strength of the club shaft 2. On the other hand, since the bias ply 6*b* has a small effect applied to the bending strength of the club shaft 2, it is possible to obtain the shaft 2 having a small amount of fiber, a light weight and a small torsion (torque) by using the fiber in which the elastic modulus is large as mentioned above. In this case, the elastic modulus in tension is assumed as a value measured in accordance with "carbon fiber testing method" of JIS R7601.

Further, the second prepreg ply 7 comprises four sheets of plies with a length in a shaft axial direction of 200 to 350 mm. The reinforcing fiber f of the second ply 7 preferably has an elastic modulus in the range of from 10000 to 30000 kgf/mm$^2$. The fiber f is oriented at 0 degree and 45 degrees with respect to the longitudinal direction of the club shaft 2.

The third prepreg ply 8 comprises one ply in the present embodiment with a length in the shaft axial direction of 35 to 450 mm, from the butt end 2B of the club shaft 2. The ply 8 preferably has, for example, a high modulus fiber f with the elastic modulus in the range of from 26000 to 80000 kgf/mm$^2$. Further, the fiber f is oriented in the longitudinal direction of the club shaft 2, however, is not limited to this.

The golf grip 4 is formed, for example, by molding and vulcanizing a material obtained by blending and mixing oil, a carbon black, sulfur and a zinc oxide to a natural rubber in a predetermined shape. In this embodiment, the grip has a grip entire length of 272 mm (about 10.7 inch) and a grip weight of 40 to 50 g.

The golf grip 4 has the upper end 4*e* by the side of the butt end 2B of the club shaft 2. Here, the upper end 4*e* of the golf grip 4 means a rearmost end of the grip 4. However, in the case that the grip has a bulge 4*t* protruding upward as shown in FIG. 6, an edge in an upper side of a most expanded grip is defined as the upper end 4*e* of the grip 4.

Figure 5:
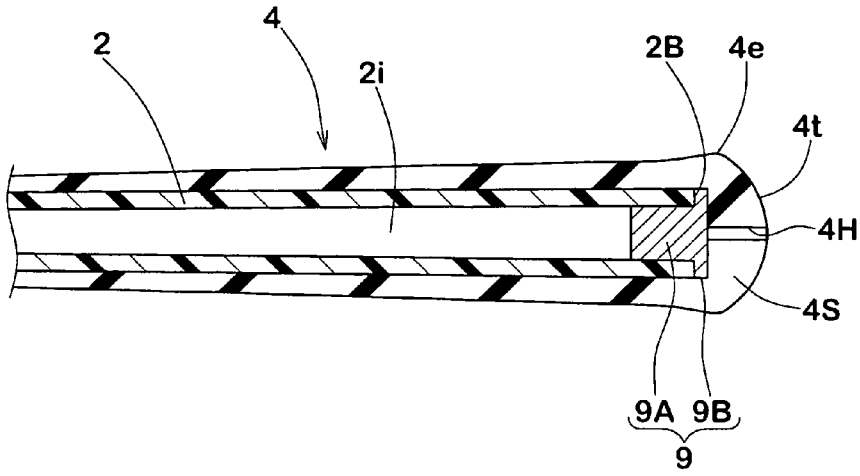
FIG. 5 is a cross sectional view of an upper end side of the grip showing a weight member.
Figure 6:
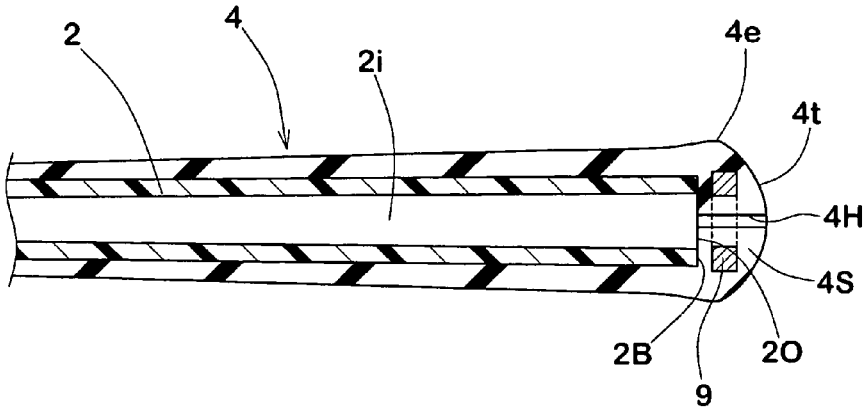
FIG. 6 is a cross sectional view of an upper end side of the grip showing the other weight member.

Further, in the present embodiment, the golf club has a weight member 9 arranged in the butt end side 2B of the of the club shaft 2 and/or the upper end 4*e* side of the golf grip 4, as shown in FIG. 5 or 6.

In FIG. 5, the weight member 9 is firmly fixed to the butt end 2B of the shaft 2. The weight member 9 in accordance with the present embodiment comprises a base portion 9A which can be inserted to a hollow portion 2*i* of the club shaft 2 from the butt end 2B thereof and a flange portion 9B having a larger diameter than the base portion 9A so as to cover the butt end 2B . Therefore, the flange portion 9B is sandwiched between the butt end 2B of the shaft 2 and a bottom of the golf grip 4.

The weight member 9 can be firmly fixed to the shaft 2 integrally so as to be immobile, for example, by a thread groove provided in the base portion 9A and/or an adhesive agent. Further, the flange portion 9B serves for inhibiting the movement of the weight member 9 within the shaft 2.

Further, in the embodiment in FIG. 6, the weight member 9 is disposed in the grip 4 at side of the upper end 4*e* thereof.

The weight member 9 in accordance with this embodiment is formed in an annular body and a center thereof is substantially aligned with a center of the shaft 2. The weight member 9 is, for example, previously installed in the rubber at a time of vulcanizing the grip 4 and can be fixed into the grip 4 so as to be immobile in accordance with an integral vulcanization.

Further, the upper end portion 4S of the grip 4 covering the butt end 2B of the shaft 2 has a vent hole 4H extending from an opening 2O of the butt end 2B to outside the grip 4. The vent hole 4H is provided for discharging an air to the outside of the grip 4 between the grip 4 and the shaft 2 at a time of installing the grip 4 to the butt end 2B of the shaft 2. Since the weight member 9 extending around the vent hole 4H in accordance with the present embodiment does not close the vent hole 4H of the grip 4, the weight member 9 does not deteriorate the installation property of the grip 4.

In all of the aspects, the weight member 9 employs a high specific gravity material having a great specific gravity for achieving a compact size and securing a great weight. Although the high specific gravity material is not particularly limited as far as the specific gravity is greater than the shaft 2, it is possible to preferably employ a metal material such as a tungsten, a tungsten alloy, a copper alloy, a nickel alloy and the like, particularly preferably employ a metal material in which the specific gravity is not less than 5.0, and more preferably not less than 6.0, and further preferably not less than 7.0. In this case, if the specific gravity is too large, a workability and a productivity of the material tend to be lowered. Accordingly, it is desirable that the specific gravity is preferably not more than 13.0, more preferably not more than 12.0, and further preferably not more than 11.0.

Further, it is desirable that the weight of the weight member 9 is preferably not less than 2% of the head weight, more preferably not less than 3%, and further preferably not less than 4%. In the case that the weight of the weight member 9 is not more than 2%, there is a tendency that the effect of making the swing weight of the club 1 small can not be sufficiently obtained. On the contrary, if the weight of the weight member 9 becomes too large, the total weight of the club is increased, so that it is hard to swing in spite of a reduced swing weight. From this point of view, it is preferable that the weight of the weight member 9 is not more than 9% of the head weight, and more preferably not more than 8%.

Figure 7:
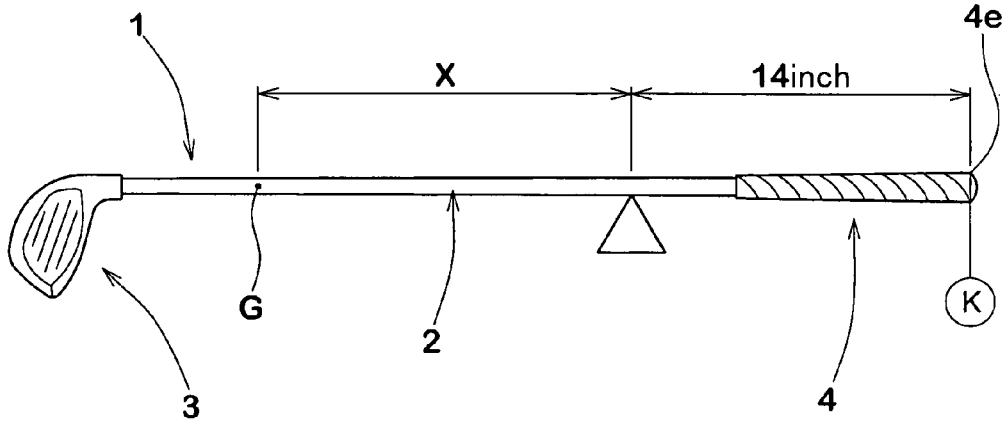
FIG. 7 is a graph explaining a swing weight.

The swing weight of the golf club 1 mentioned above (which may be called as "swing balance") expresses a body sensory weight at a time of swinging the golf club, and is determined by setting a position of 14 inch along a shaft axis from the upper end 4*e* of the grip 4 to a fulcrum, and on the basis of a numerical value (unit: inch·ounce) obtained by multiplying a distance X (unit: inch) in a direction of the shaft axis from the fulcrum to a center of gravity G by a club entire weight k(unit: ounce), as shown in FIG. 7.

The numerical value showing the swing weight is sectionalized into six stages A to F, and indicates that the weight becomes heavy from "A" toward "F". Further, each of the sections A to F is further divided into ten sections 0 to 9, and means that the weight becomes heavy from "0" toward "9". Further, the final swing weight is expressed by a mark of any one of alphabets A to F indicating the section with any one of numerals 0 to 9 such as "A0" or "C6".

Table 1 shows a corresponding relation between a notation of the mark of the swing weight and the numerical value (inch-ounce) mentioned above just for reference. In the golf club in accordance with the present invention, the numerical value is approximately included in a range of 204.75 to 213.5.

TABLE 1

| Swing weight | | Inch · Ounce |
|---|---|---|
| C | 0 | 196 |
| | 1 | 197.75 |
| | 2 | 199.5 |
| | 3 | 201.25 |
| | 4 | 203 |
| | 5 | 204.75 |
| | 6 | 206.5 |
| | 7 | 208.25 |
| | 8 | 210 |
| | 9 | 211.75 |
| D | 0 | 213.5 |
| | 1 | 215.25 |
| | 2 | 217 |
| | 3 | 218.75 |
| | 4 | 220.5 |
| | 5 | 222.25 |
| | 6 | 224 |
| | 7 | 225.75 |
| | 8 | 227.5 |
| | 9 | 229.25 |

Figure 8:
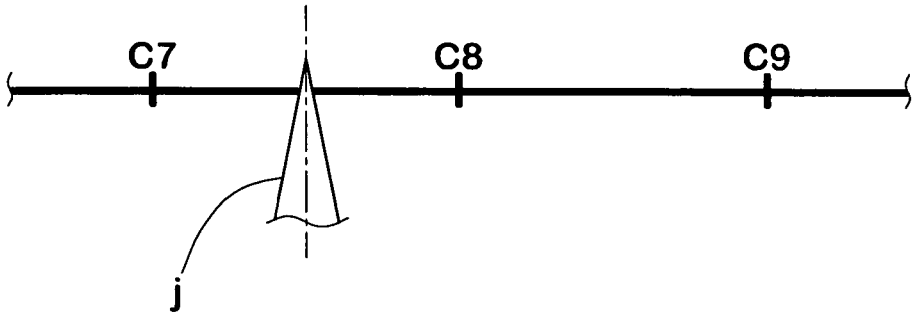
FIG. 8 is a graph explaining a scale of a swing weight measuring instrument.

In the present specification, the swing weight is measured by using a 14-inch balance measuring instrument (not shown) measuring a weight in the head side by setting a position 14 inch apart from the upper end 4*e* of the grip 4 to the fulcrum, and reading a scale indicated by an indicator. Since a measuring scale of the swing weight measuring instrument has a width between minimum reading scales (for example, C7 , C8 , C9 or the like), as briefly shown in FIG. 8, for example, there is a case that an indicator j indicates an intermediate position of the scales C7 and C8 . In the present specification, in the case mention above, the swing weight having the smaller scale (C7 in this example) is employed. Further, when the indicator j indicates a position between the scales and the other positions than the intermediate position, the scale nearer to the indicator j is read as the swing weight.

Figure 9:
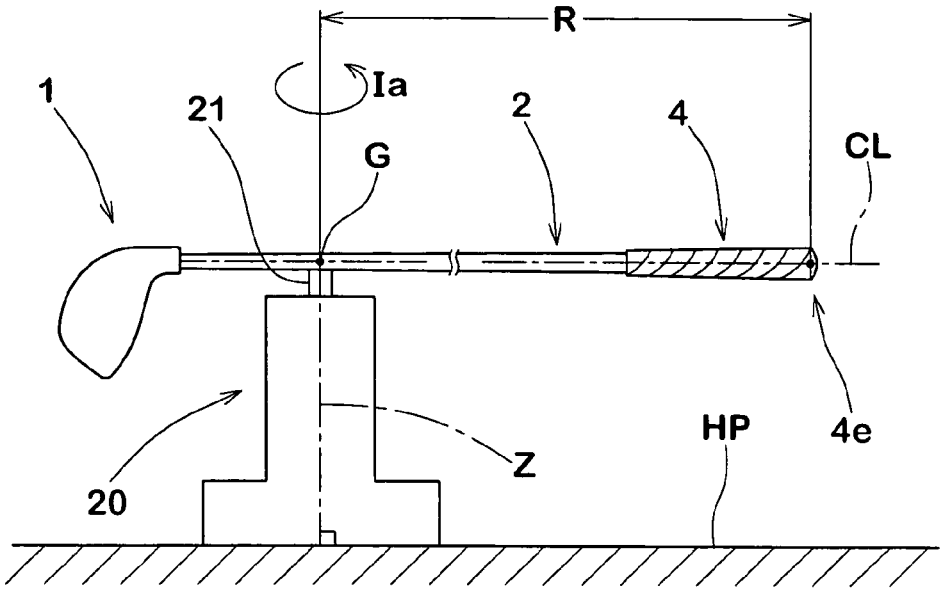
FIG. 9 is a graph explaining a measuring method of a moment of inertia at an upper end of a golf grip.

Further, the moment of inertia of the golf club 1 at the upper end 4*e* of the grip 4 is measured by supporting the club 1 with balance on a measuring jig 21 of an inertia moment measuring instrument 20 (for example, a measuring device such as MODEL NUMBER RK/005-002 manufactured by INERTIA DYNAMICS Inc. or the like) in such a manner that an axial center line CL of the shaft 2 becomes horizontal as shown in FIG. 9. At this time, the center of gravity G of the golf club 1 is supported by the measuring jig 21.

Next, a moment of inertia Ia of the club 1 around the center of gravity G (in which a rotation axis corresponds to z) is measured. Further, a moment of inertia IG of the golf club at the upper end of the golf grip is determined in accordance with a calculation on the basis of the following expression while using a parallel axis theorem.

$$IG(\text{kg}\cdot\text{cm}^2)=Ia+m\cdot R^2$$

In which reference symbol "m" denotes a mass (kg) of the club, reference symbol "R" denotes an axial distance (cm) from the upper end 4*e* of the grip 4 to the center of gravity G of the golf club 1, and reference symbol "Ia" denotes a moment of inertia (kg·cm$^2$) around the center of gravity G of the golf club 1.

Figure 10:
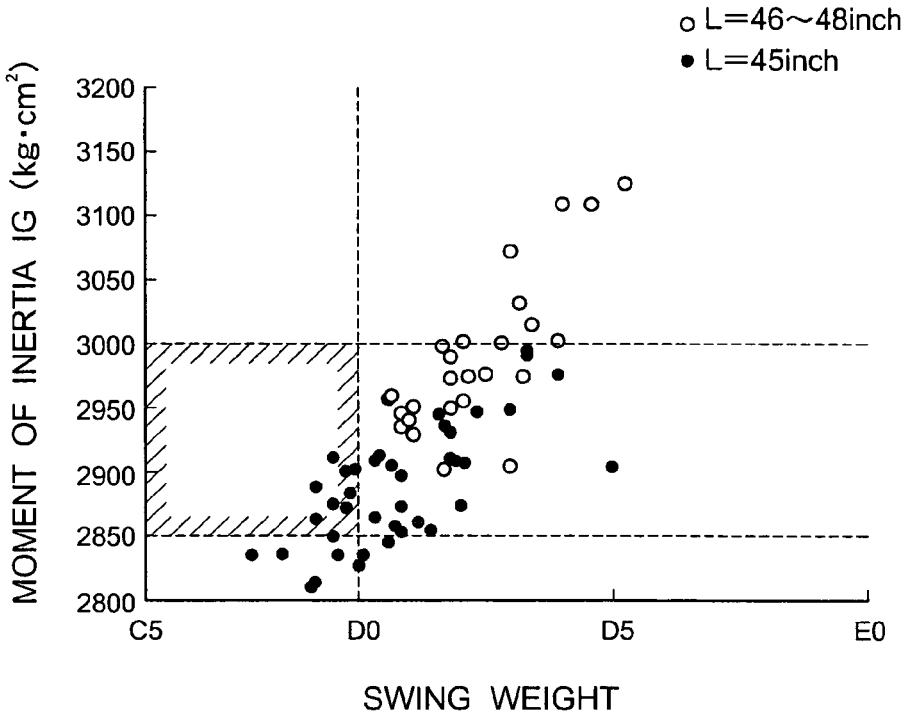
FIG. 10 is a graph showing a relation between the moment of inertia and the swing weight at an upper end of a golf grip.

FIG. 10 shows a result obtained by measuring the moment of inertia IG and the swing weight in the conventional golf club. AS is apparent from FIG. 10, it is known that the conventional 45-inch club has a swing weight D0 or smaller. However, the golf club not less than 46 inch has a swing weight more than D0. Further, it can be read that the moment of inertia IG is increased approximately in proportion to the swing weight.

On the contrary, the golf club 1 in accordance with the present embodiment is manufactured in accordance with at least one means of the lightening the club head 3, the lightening the shaft 2, the increase of the relative weight in the butt end 2B side of the shaft 2 and the layout of the weight member 9 as mentioned above, such that the swing weight is in the range of from C5 to D0 , and the moment of inertia IG of the club at the upper end 4*e* of the grip 4 is in the range of from 2850 to 3000 kg·cm$^2$. In other words, it is possible to have the moment of inertia IG to approximately the same level as the conventional one, and it is possible to make the swing weight small, while setting the entire length of the club longer such as 46 to 48 inch.

In the golf club 1 mentioned above, it is possible to expect an improvement of the head speed on the basis of the elongation. Further, since the swing weight of the club 1 in accordance with the present embodiment does not make much difference from the short club in which the swing weight is about 45 inch, it is possible to sufficiently improve the operability of the club at a timing such as a time of starting the backswing and a time just before hitting the ball. Accordingly, it is easy to swing, and it is possible to achieve precise backswing and club control. Therefore, it is possible to regulate the opening of the club face F, so that it is possible to accurately carry the ball far at a large head speed while preventing the slice.

In particularly preferable, it is desirable that the swing weight of the club 1 is in the range of from C6 to C9. Further, it is desirable that the moment of inertia IG is particularly preferably not less than 2870 kg·cm$^2$, and further preferably not less than 2930 kg·cm$^2$, and it is desirable that an upper limit thereof is not more than 2980 kg·cm$^2$.

The golf club 1 in accordance with the present embodiment can reduce the weight felt at a time of swinging by making the swing weight small, and can improve a swing easiness while elongating. However, in particularly preferable, it is desirable to further limit the entire weight of the club 1. In other words, if the entire weight of the club is too heavy, a weight holding feeling tends to be generated even if the swing weight is made small. On the contrary, if the entire weight is too light, it is hard to secure timing at the swinging time, and there is a tendency that a directionality of the hit ball is deteriorated. From this point of view, the entire weight of the club is preferably not less than 285 g, and more preferably not less than 289 g, and an upper limit thereof is preferably not more than 300 g, and more preferably not more than 298 g.

The description is given above of the embodiment in accordance with the present invention. However, the present invention is not limited to the embodiment mentioned above, but can be variously modified within the scope of the present invention.

comparison Test:

A wood type golf club (a driver) is manufactured by way of trial on the basis of the specification in Table 2. The basis structure of the club is as mentioned above. Each of data is regulated by changing a volume of the club head, the head weight, the shaft weight and/or the weight of the weight member on the basis of the example 3. Further, each of the clubs is tested with respect to the swing easiness, the carry of the hit ball and the directionality of the hit ball. The testing method is as follows.

Swing Easiness:

Ten golf balls are actually hit by each of thirty golfers having wide skill levels of handicaps from 5 to 30, and the swing easiness is evaluated by each of the golfers in accordance with a feeling evaluation. A rating standard is as follows, and an average value of thirty golfers is displayed. The larger the numerical value is, the better the swing easiness is.

5: very easy to swing
4: slightly easy to swing
3: regular
2: slightly hard to swing
1: very hard to swing Carry of Hit Ball:

Each of the trial clubs is attached to a swing robot (manufactured by Golf Laboratories Co., Ltd), and a swing speed of the robot is regulated such that the head speed is 40 m/s in the golf club in accordance with the example 6. Then, ten golf balls are hit by each of the clubs, and an average value of the carries is displayed. The larger the numerical value is, the better the carry of hit ball is.

Directionality of Hit Ball:

The test was executed by hitting every ten balls by ten golfers having handicaps between 10 to 20, measuring a shortest distance from a straight line obtained by connecting a target and a hitting point to a ball stop position (the measured value is set to a plus value whichever the ball is shifted to the right or the left with respect to the target), and calculating an average value of ten balls in each of the golfers. Further, an evaluation is executed by determining an average value of ten golfers. The smaller the numerical value is, the better the directionality is.

Figure 11:
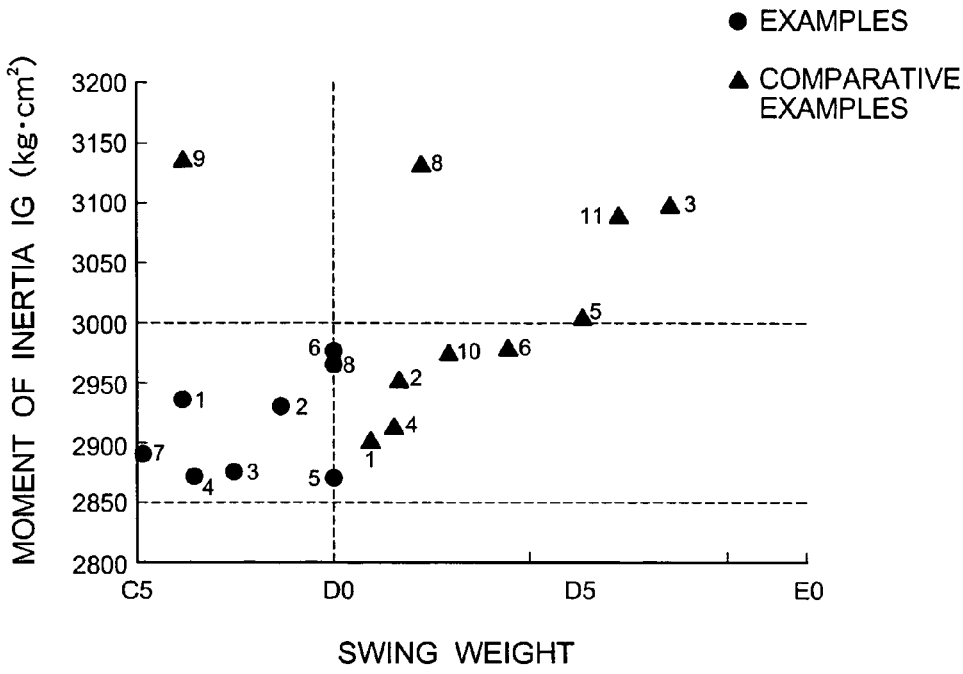
FIG. 11 is a graph showing a relation between the moment of inertia and the swing weight at the upper end of the grip in the example and a comparative example.
Figure 12:
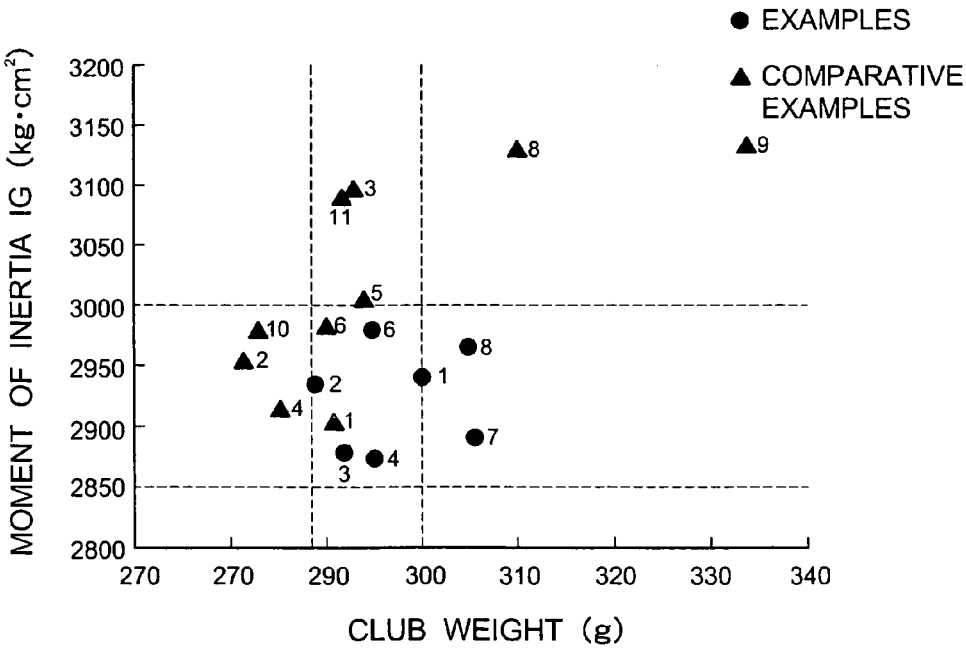
FIG. 12 is a graph showing a relation between the moment of inertia at the upper end of the grip and an entire weight of the club in the example and the comparative example.

The results of the tests and the like are shown in Table 2. Further, the data of each of the examples is shown in FIGS. 11 and 12.

TABLE 2

| | Example 1 | Example 2 | Example 3 | Example 4 | Example 5 | Example 6 | Example 7 | Example 8 | Example 9 |
|---|---|---|---|---|---|---|---|---|---|
| Club Entire Length [inch] | 46 | 46 | 46 | 46 | 46 | 47 | 46 | 46 | 48 |
| Swing Weight | C6 | C9 | C7 | C6 | D0 | D0 | C5 | D0 | D0 |
| Moment of Inertia IG [kg · cm$^2$] | 2938 | 2932 | 2876 | 2872 | 2872 | 2978 | 2893 | 2967 | 2990 |
| Club Entire Weight [g] | 300.0 | 288.7 | 292.0 | 295.3 | 287.6 | 295.1 | 306.0 | 305.3 | 300.1 |
| Club Head Weight [g] | 191.0 | 191.0 | 186.9 | 187.5 | 187.8 | 185.5 | 187.1 | 193.1 | 185.1 |
| Grip Weight [g] | 42.0 | 42.0 | 42.5 | 42.5 | 42.5 | 42.5 | 42.5 | 42.5 | 42.5 |
| Weight of Weight Member [g] | 16.0 | 5.0 | 5.0 | 8.0 | 0 | 9.0 | 19.0 | 13.0 | 12.0 |
| Head volume [cm$^3$] | 420 | 420 | 460 | 460 | 460 | 460 | 460 | 460 | 460 |
| Test Carry of Hit Ball | 226.5 | 226.0 | 225.5 | 225.8 | 225.9 | 229.5 | 225.0 | 226.6 | 230.6 |

TABLE 2-continued

| | | Example 1 | Example 2 | Example 3 | Example 4 | Example 5 | Example 6 | Example 7 | Example 8 | Example 9 |
|---|---|---|---|---|---|---|---|---|---|---|
| Result | [yard] | | | | | | | | | |
| | Directionality of Hit Ball [yard] | 4.1 | 6.3 | 9.7 | 8.0 | 9.6 | 10.0 | 16.3 | 15.8 | 16.9 |
| | Swing Easiness [1 to 5 scale] | 3.5 | 3.4 | 3.0 | 3.1 | 3.0 | 3.2 | 2.7 | 2.6 | 2.4 |

| | | Comparative Example 1 | Comparative Example 2 | Comparative Example 3 | Comparative Example 4 | Comparative Example 5 | Comparative Example 6 |
|---|---|---|---|---|---|---|---|
| Club Entire Length [inch] | | 45 | 46 | 46 | 46 | 46 | 46 |
| Swing Weight | | D1 | D2 | D9 | D2 | D6 | D4 |
| Moment of Inertia IG [kg · cm$^2$] | | 2903 | 2954 | 3098 | 2915 | 3006 | 2982 |
| Club Entire Weight [g] | | 290.9 | 281.4 | 293.0 | 285.3 | 294.1 | 290.0 |
| Club Head Weight [g] | | 193.0 | 191.0 | 200.0 | 187.1 | 196.1 | 193.1 |
| Grip Weight [g] | | 42.5 | 42.5 | 42.5 | 42.5 | 42.5 | 42.5 |
| Weight of Weight Member [g] | | 0 | 0 | 0 | 0 | 0 | 0 |
| Head volume [cm$^3$] | | 410 | 420 | 420 | 460 | 460 | 460 |
| Test Result | Carry of Hit Ball [yard] | 220.0 | 226.4 | 227.0 | 225.4 | 226.3 | 225.9 |
| | Directionality of Hit Ball [yard] | 10.1 | 18.3 | 19.2 | 15.9 | 17.8 | 15.4 |
| | Swing Easiness [1 to 5 Scale] | 3.2 | 2.0 | 1.8 | 2.6 | 2.2 | 2.4 |

| | | Comparative Example 7 | Comparative Example 8 | Comparative Example 9 | Comparative Example 10 | Comparative Example 11 | Comparative Example 12 | Comparative Example 13 |
|---|---|---|---|---|---|---|---|---|
| Club Entire Length [inch] | | 47 | 47 | 47 | 47 | 47 | 48 | 48 |
| Swing Weight | | E1 | D2 | C6 | D3 | D7 | D6 | E0 |
| Moment of inertia IG [kg · cm$^2$] | | 3178 | 3133 | 3136 | 2978 | 3091 | 2995 | 3250 |
| Club Entire Weight [g] | | 292.6 | 310.3 | 334.6 | 282.9 | 291.9 | 288.1 | 295.2 |
| Club Head Weight [g] | | 195.0 | 191.0 | 191.0 | 185.5 | 193.2 | 185.1 | 190.6 |
| Grip weight [g] | | 42.0 | 42.0 | 42.0 | 42.5 | 42.5 | 42.5 | 42.5 |
| Weight of Weight Member [g] | | 0 | 25.0 | 49.0 | 0 | 0 | 0 | 0 |
| Head volume [cm$^3$] | | 420 | 420 | 420 | 460 | 460 | 460 | 460 |
| Test Result | Carry of Hit Ball [yard] | 230.0 | 229.8 | 229.5 | 229.8 | 229.3 | 230.3 | 231.4 |
| | Directionality of Hit Ball [yard] | 27.2 | 22.4 | 23.5 | 18.7 | 20.1 | 25.1 | 31.4 |
| | Swing Easiness [1 to 5 Scale] | 0.8 | 1.5 | 1.5 | 2.0 | 1.7 | 1.2 | 0.5 |

As a result of the tests, it is confirmed that the swing easiness is improved in the clubs in accordance with the examples in comparison with the comparative examples, so that the clubs in accordance with the examples are excellent in the carry of hit ball and the directionality of hit ball while being long. On the contrary, in the comparative example 1 in which the entire length of the club is short, it is known that the improvement of the carry can not be sufficiently expected while the club is easy to swing.

Further, in the comparative examples 2, 4 and 7 in which the entire length is long, the moment of inertia IG is proper and the swing weight is large, it can be confirmed that the displacement of the hit ball is very large.

Further, in the comparative example 9 in which the entire length is long, the swing weight is proper, and the moment of inertia IG is large, it can be confirmed that the displacement of the hit ball becomes further larger.

The invention claimed is:

1. A golf club comprising a club shaft having a tip end and a butt end, a golf club head being attached to the tip end of said club shaft, and a golf grip being attached to a region of the club shaft extending from the butt end toward the tip end of the club shaft, the golf grip having an upper end by the side of the butt end of the club shaft, wherein the golf club has a club entire length in the range of from 46 to 48 inch, the golf club has a swing weight of from C5 to D0 based on 14-inch balance method, and the golf club has a moment of inertia in the range of from 2850 to 3000 kg·cm$^2$ at the position of the upper end of said golf grip.

2. The golf club according to claim 1, wherein the golf club has a entire weight in the range of from 285 to 300 g.

3. The golf club according to claim 1, wherein the golf club has the moment of inertia in the range of from 2930 to 2980 kg·cm$^2$ at the position of the upper end of the golf grip.

4. The golf club according to claim 1, wherein the golf club has the swing weight of from C6 to C9.

5. The golf club according to claim 1, wherein the golf club head has a club head weight in the range of from 180 to 195 g.

6. The golf club according to claim 1, wherein the club shaft is provided with a weight member for adjusting the swing weight at the side of the butt end, and the weight member has a weight in the range of from 2 to 9% the weight of the golf club head.

7. The golf club according to claim 6, wherein the club shaft has a tubular body having a hollow therein, and the weight member comprises a base portion inserted into the hollow portion of the club shaft from the butt end thereof and a flange portion covering the butt end of the club shaft and sandwiched between the butt end of the club shaft and a bottom of the golf grip.

8. The golf club according to claim 1, wherein the golf grip is provided with a weight member for adjusting the swing weight at the side of the upper end, and the weight member has a weight in the range of from 2 to 9% the weight of said golf club head.

9. The golf club according to claim 8, wherein the club shaft has a tubular body having an opening at the butt end, the golf grip has a vent hole extending from the opening of the butt end of the club shaft to outside of the grip, and the weight member has an annular body extending around the vent hole.

* * * * *